US011699418B1

(12) United States Patent
Derr et al.

(10) Patent No.: US 11,699,418 B1
(45) Date of Patent: Jul. 11, 2023

(54) STRINGED INSTRUMENT PLECTRUM HAVING AN INLAID CENTER PORTION

(71) Applicants: Isaac Daniel Derr, Chapel Hill, NC (US); Gerald Francis Brown, Chapel Hill, NC (US)

(72) Inventors: Isaac Daniel Derr, Chapel Hill, NC (US); Gerald Francis Brown, Chapel Hill, NC (US)

( * ) Notice: Subject to any disclaimer, the term of this patent is extended or adjusted under 35 U.S.C. 154(b) by 0 days.

(21) Appl. No.: 18/099,150

(22) Filed: Jan. 19, 2023

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS 1,416,212 A * 5/1922 Kaufmann ..... B44C 1/26 156/220
4,711,150 A * 12/1987 Hyduck ..... G10D 3/173 84/322
6,127,613 A * 10/2000 Hansel ..... G10D 3/173 84/320
D436,984 S * 1/2001 Hansel ..... 84/322
6,835,881 B1 * 12/2004 Jackson ..... A44B 15/005 84/322
7,238,869 B1 * 7/2007 Kleckzka ..... G10D 3/173 84/322
7,265,285 B2 * 9/2007 Storey ..... G10D 3/173 84/322
8,035,017 B1 * 10/2011 Morris ..... G10D 3/173 84/320
9,343,046 B2 * 5/2016 Fletcher ..... G10D 1/08
9,418,632 B2 * 8/2016 Snyder ..... G10D 3/173
11,170,744 B1 * 11/2021 Labbe ..... G10D 3/173
2004/0118265 A1 * 6/2004 Katz ..... G10D 3/173 84/322
2004/0237753 A1 * 12/2004 Savage ..... G10D 3/173 84/322

FOREIGN PATENT DOCUMENTS

FR 2966633 A1 * 4/2012 ..... G10D 3/163
WO WO-0023981 A1 * 4/2000 ..... B29C 59/022

* cited by examiner

*Primary Examiner* — Robert W Horn

(57) ABSTRACT

A stringed instrument plectrum being made primarily from a material with desirable edge properties and from one or more secondary materials with desirable flexibility, density, and or tactile qualities. The primary material is formed so that there is one or more central recesses that are then filled by the secondary material in order to modify the flexibility and or tactile nature of the plectrum while maintaining the edge properties of the primary material and keeping the central section of the plectrum a generally uniform thickness.

3 Claims, 1 Drawing Sheet

STRINGED INSTRUMENT PLECTRUM HAVING AN INLAID CENTER PORTION

FIELD OF INVENTION

The invention relates to stringed instrument plectrums.

BACKGROUND

It is known to the art that plectrums (also referred to as picks) come in many materials and thicknesses to facilitate the needs of musicians. Some plectrums are made from very pliant materials such as felt or nylon to meet the needs of musicians that prefer a more flexible plectrum and or the softer sound of said materials, however many of these materials do not have desirable edge retention due to the soft nature of said pliant materials, therefore said picks wear quickly. Other plectrums are made from very hard wearing materials such as horn or bone for their sonic and edge retention qualities, but these materials tend to be extremely rigid. In the past plectrum thickness has been the primary way of modifying the flexibility of a plectrum of any given material, however some materials do not perform well when they are very thin and may become brittle or highly malleable. Other materials do not perform well when they are made thicker as the added thickness does not have the desired effect on the rigidity of the plectrum. The variables of edge quality, flexibility, and plectrum thickness can be hard to balance in order to give a musician their desired playing experience. The present invention allows the edge of the pick to be made of one material and the center of the plectrum to be made from one or more materials in order to take control of the previously mentioned variables. By inlaying a highly flexible material within the center of a plectrum made from a highly rigid material, the edges retain the qualities of the base material but the overall flexibility of the plectrum is increased. Alternatively a highly rigid material can be inlaid into a softer material in order to give a plectrum a more rigid feel while still maintaining the desired thickness and sonic qualities of the softer edge material. By combining different combinations of pick thickness, primary material, and inlay material/depth, the present invention offers the best qualities of two or more different materials in one plectrum.

A SHORT SUMMARY OF THE INVENTION

The present invention serves the needs of musicians by allowing them a plectrum with the edge qualities of a primary material while also gaining the attributes such as density, rigidity, and feel of one or more secondary materials.

The material inlaid into the surface of the plectrum might take on many different shapes as long as said inlay pattern does not interrupt the playing edge of the plectrum. The primary purpose of the inlay is to modify the structural nature of the plectrum as a whole without modifying the properties of its playing edge. Different inlay patterns, depths, and sizes can be utilized to modify the structure of a plectrum, thus modifying the overall feel and playing characteristics of the plectrum. In some cases the plectrum may have a material inlaid into one face and then have material removed from the opposing face so that the inlay is present throughout the entire thickness of the plectrum. Depending on how the recess for the inlay is cut or formed the recesses may or may not be cut in a way that creates more flexibility in one direction than another. In other words, the plectrum may be easier to bend inwards towards the inlay than outwards away from the inlay.

These and other embodiments, advantages, and features of this invention will be apparent from the following description, drawings, and appended claims.

DETAILED DESCRIPTION

The present invention is a stringed instrument plectrum, as is known to the art, designed to have the playing edge qualities of a primary material and the flexibility, density, and or tactile qualities of one or more secondary materials. The claimed invention could be a flatpick, fingerpick, or thumbpick as all these designs of plectrum serve to benefit from the qualities of the described invention.

The primary material of the plectrum is machined or formed so that it has one or more recesses that, depending on the depth of the recesses, may or may not extend throughout the thickness of the plectrum. The depth and size of the recesses directly correlates with the degree and nature of how any given secondary material will affect the flexibility of the plectrum. Depending on the individual embodiment of the said invention, the flex of the plectrum will be affected differently in areas where the inlaid second material may extend all the way through the entire thickness of the plectrum as opposed to those areas where the inlay does not extend all the way through the plectrum. In the areas where the inlay extends partially through the plectrum, depending on whether the inlaid material is more or less amenable to compression than the primary material of the plectrum, the plectrum may flex more readily in one direction as opposed to another. This is different from conventional plectrums that flex uniformly in both picking directions. The present invention would allow the player the feeling of a more flexible plectrum when picking in one direction and a more rigid plectrum while picking in the opposite picking direction, depending on how they oriented the plectrum to the strings of the instrument they were playing. The areas where the inlay is present equally on both faces of the plectrum or extends all the way through the plectrum would have a uniform flex profile as the design of the plectrum would be mirrored in its cross section, however these embodiments would still have the edge qualities of the primary material while still imparting the flexibility of the secondary material as opposed to a conventional plectrum where the flexibility of the plectrum is determined by the same material that acts as the playing edge of the plectrum. Depending on the desired plectrum qualities that a musician wants, different embodiments of the invention can be designed to meet the individual play styles of a musician. Some embodiments may have an inlay on each face of the plectrum, while other embodiments may have only one face of the plectrum inlaid, while other embodiments might have an inlay that extends throughout the thickness of the plectrum for part of or all of the inlaid areas.

The Figures represent particular embodiments, and are not intended to be construed as limiting the invention.

Figure 1:
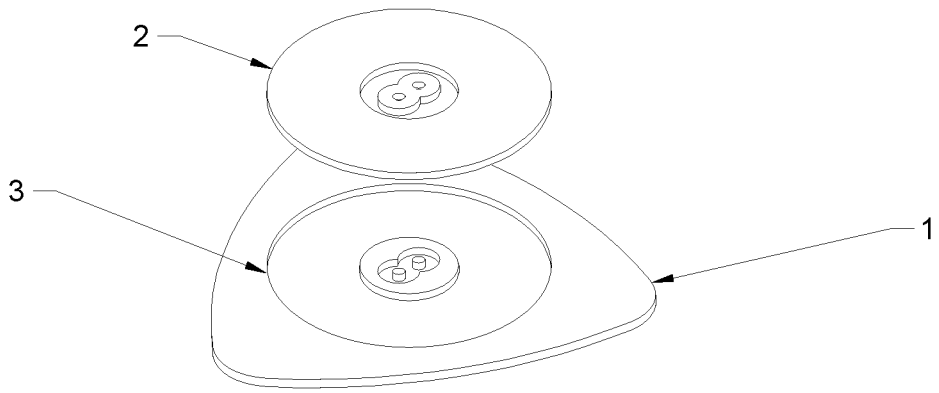
FIG. 1. An exploded isometric view of an embodiment of the invention.

Referring now to the Figures,

FIG. 1 is an exploded isometric view of an embodiment of the invention showing the primary material of the plectrum 1, the recesses 2, and the inlay of the invention as a solid piece before being glued into the recesses 2.

Figure 2:
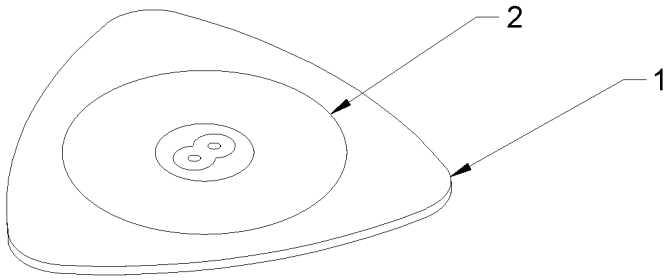
FIG. 2. An Isometric view of an embodiment of the invention.

FIG. 2 is an isometric view of an embodiment of the invention showing the primary material 1 and the inlays 2 having either been poured into the recesses or glued in place as solid pieces.

Figure 3:
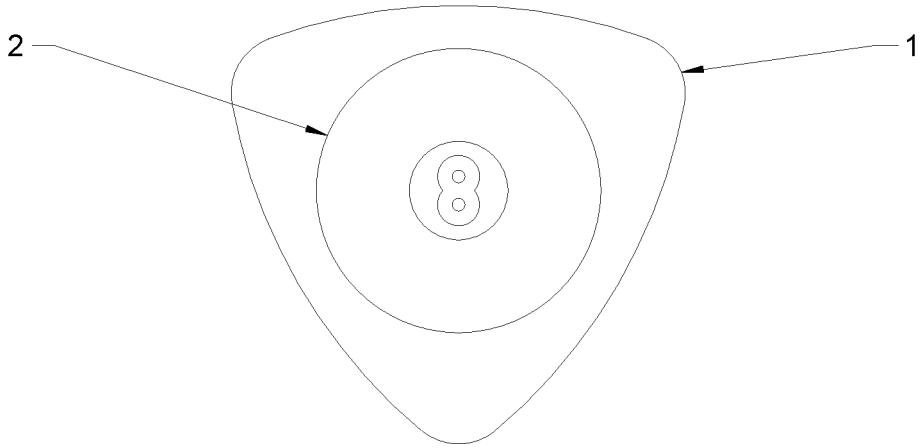
FIG. 3. A top down view of an embodiment of the invention.

FIG. 3 is a top down view of an embodiment of the invention showing the primary material 1 and the inlays 2 having either been poured into the recesses or glued in place as solid pieces.

The invention claimed is:

1. A stringed instrument plectrum, having multiple concentric central recesses cut and or formed into the surface of one or both faces of said plectrum, each recess being separated from the others by a section of non recessed material, in order to allow a secondary material to be inlaid into said recesses.

2. The one or more recesses of claim 1, being positioned and dimensioned so as not to interrupt the playing edge of the plectrum, meaning that the recesses are circumscribed by the primary material of the plectrum.

3. The secondary material of claim 1, being inlaid into the recesses present in the primary material of the plectrum in order to change the density and pliant nature of the of the plectrum while allowing the edge of the plectrum to retain the qualities of the primary plectrum material and maintaining a generally uniform thickness throughout the central area of the plectrum.

* * * * *